US012104806B2

(12) United States Patent
Li et al.

(10) Patent No.: US 12,104,806 B2
(45) Date of Patent: Oct. 1, 2024

(54) DEHUMIDIFIER

(71) Applicants: GD MIDEA AIR-CONDITIONING EQUIPMENT CO., LTD., Foshan (CN); MIDEA GROUP CO., LTD., Foshan (CN)

(72) Inventors: Weiming Li, Foshan (CN); Zhiming Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 249 days.

(21) Appl. No.: 17/617,653

(22) PCT Filed: Oct. 25, 2019

(86) PCT No.: PCT/CN2019/113204
§ 371 (c)(1),
(2) Date: Dec. 9, 2021

(87) PCT Pub. No.: WO2020/258617
PCT Pub. Date: Dec. 30, 2020

(65) Prior Publication Data

US 2022/0243930 A1 Aug. 4, 2022

(30) Foreign Application Priority Data

Jun. 25, 2019 (CN) ..... 201910547374.8
Jun. 25, 2019 (CN) ..... 201920967885.0

(51) Int. Cl.
*F24F 1/0358* (2019.01)
*F24F 11/89* (2018.01)
(Continued)

(52) U.S. Cl.
CPC ..... *F24F 1/0358* (2019.02); *F24F 11/89* (2018.01); *F24F 13/20* (2013.01); *F24F 13/222* (2013.01)

(58) Field of Classification Search
CPC ..... F24F 1/0358; F24F 11/89; F24F 13/20; F24F 13/222
See application file for complete search history.

(56) References Cited

FOREIGN PATENT DOCUMENTS

CN 1699854 A 11/2005
CN 201069295 Y 6/2008
(Continued)

OTHER PUBLICATIONS

World Intellectual Property Organization (WIPO) International Search Report and Written Opinion for PCT/CN2019/113204 Mar. 27, 2020 17 pages (with translation).
(Continued)

*Primary Examiner* — Kun Kai Ma
(74) *Attorney, Agent, or Firm* — Anova Law Group, PLLC

(57) ABSTRACT

A dehumidifier includes a housing having a mounting groove, a water tank detachably inserted in the mounting groove and including an abutment member, a pump assembly including a water pump and a water pump inlet pipe, a water tank outlet pipe, and a micro switch installed at the housing. A first end of the water pump inlet pipe is connected to the water pump. A first end of the water tank outlet pipe is detachably connected to a second end of the water pump inlet pipe. A second end of the water tank outlet pipe is located in the water tank. When the water tank is installed in place, the micro switch is pressed by the abutment member to connect the water pump to a power supply, and the water pump inlet pipe is communicated with the water tank outlet pipe.

13 Claims, 6 Drawing Sheets

(51) Int. Cl.
*F24F 13/20* (2006.01)
*F24F 13/22* (2006.01)

(56) References Cited

FOREIGN PATENT DOCUMENTS

| | | | | | |
|---|---|---|---|---|---|
| CN | 202501583 | U | * | 10/2012 | |
| CN | 103673214 | A | | 3/2014 | |
| CN | 204084737 | U | * | 1/2015 | ..... F04F 10/00 |
| CN | 204555085 | U | | 8/2015 | |
| CN | 105588180 | A | | 5/2016 | |
| CN | 205783344 | U | | 12/2016 | |
| CN | 109780642 | A | | 5/2019 | |
| CN | 210128455 | U | | 3/2020 | |
| JP | 858124130 | A | | 7/1983 | |
| JP | 2006043523 | A | * | 2/2006 | |
| KR | 20090129524 | A | | 12/2009 | |
| WO | WO-2020192003 | A1 | * | 10/2020 | ..... B01D 53/265 |

OTHER PUBLICATIONS

China National Intellectual Property Administration (CNIPA) Office Action 1 for 201910547374.8, Jan. 12, 2024 20 Pages (including translation).

* cited by examiner

DEHUMIDIFIER

CROSS-REFERENCE TO RELATED APPLICATIONS

This application is a National Stage Entry under 35 U.S.C. § 371 of International Application No. PCT/CN2019/113204, filed on Oct. 25, 2019, which claims priority to Chinese patent application Nos. 201910547374.8 and 201920967885.0, both filed on Jun. 25, 2019 and titled "Dehumidifier." The contents of the aforementioned applications are incorporated in this application by reference.

TECHNICAL FIELD

The present application relates to the field of air conditioning, in particular to a dehumidifier.

BACKGROUND

A dehumidifier is usually equipped with a water tank used to collect water. The water in the water tank needs to be discharged if the water tank is full. In the existing dehumidifier, after the water tank is installed, there exists a possibility that the water pipe of the water tank is not connected to the water pump. If the water pipe in the water tank is not connected to the water pump, the water pump is idling, which is easy to damage the water pump.

SUMMARY

The main purpose of the present application is to provide a dehumidifier, aiming at improving the safety of water pump's operation.

In order to achieve the above purpose, the present application provides a dehumidifier, which includes:

- a housing having a mounting groove;
- a water tank detachably inserted in the mounting groove, and provided with an abutment member;
- a pump assembly including a water pump and a water pump inlet pipe having one end connected to the water pump;
- a water tank outlet pipe having one end detachably connected to another end of the water pump inlet pipe, and another end of the water tank outlet pipe being located in the water tank; and
- a micro switch installed at the housing;
- wherein when the water tank is installed in place, the micro switch is pressed by the abutment member to connect the water pump to a power supply, and the water pump inlet pipe is communicated with the water tank outlet pipe.

Optionally, the water tank also includes a pumping bracket connected to the water tank outlet pipe.

Optionally, a tank body of the water tank includes a front plate and a back plate opposite to the front plate, and the pumping bracket is connected to the back plate.

Optionally, the abutment member is an abutment protrusion formed at the pumping bracket, and the abutment protrusion is located at an outer side of the water tank and extended away from the front plate.

Optionally, the housing also includes a partition plate forming a bottom of the mounting groove, the housing is provided with an accommodation cavity at a side of the partition plate away from the mounting groove, the partition plate is provided with an alignment hole communicating with both the mounting groove and the accommodation cavity, the micro switch is located in the accommodation cavity and facing the alignment hole, and the abutment protrusion is movably disposed through the alignment hole to abut against the micro switch.

Optionally, the pumping bracket is provided with a first adapter connected to an outlet end of the water tank outlet pipe, the partition plate is provided with a second adapter communicating with the mounting groove, an inlet end of the water pump inlet pipe is connected to the second adapter, and the first adapter is detachably plugged to the second adapter.

Optionally, the pumping bracket includes:

- a bracket body formed with the abutment protrusion and connected to the back plate, a top of the bracket body having a mounting protrusion and a first bolt arranged at interval, the mounting protrusion having a limiting hole facing the first bolt; and
- the first adapter formed with a limiting protrusion adapted to the alignment hole and a second bolt adapted to the first bolt.

Optionally, the micro switch includes an elastic trigger plate, and the micro switch has a first state in which the abutment member abuts against the elastic trigger plate to close the micro switch, and a second state in which the elastic trigger plate is reset and the micro switch is opened.

Optionally, the pumping bracket is detachably connected to the tank body of the water tank.

Optionally, the pumping bracket is buckled to the tank body of the water tank.

Optionally, the pumping bracket includes a mounting end extending into the water tank, the mounting end is provided with a filter, and an inlet end of the water tank outlet pipe is communicated with the filter.

Optionally, the water tank outlet pipe is a hose, the mounting end of the pumping bracket is provided with a mounting pipe, the filter is provided at an inlet end of the mounting pipe, and the inlet end of the water tank outlet pipe is connected to an outlet end of the mounting pipe.

Optionally, an inlet of the mounting pipe is trumpet-shaped and a radius of the outlet end of the mounting pipe is smaller than a radius of the inlet end of the mounting pipe.

In the technical schemes of the present application, the micro switch at the housing is cooperated with the abutment member at the water tank, to check whether the water tank is installed in place and whether the water tank outlet pipe of the water tank is communicated with the water pump. When the water tank is installed in place, the water tank outlet pipe of the water tank is connected to the water pump inlet pipe of the water pump so as to communicate with the water pump. At the same time, the abutment member presses the micro switch so that the water pump is connected to a power supply, and the water pump can pump out the water in the water tank and is not idling. When the abutment member does not press the micro switch, the micro switch is in an opened state, so that the water pump is disconnected from the power supply and the water pump cannot work, thereby ensuring that the water pump is not idling.

BRIEF DESCRIPTION OF THE DRAWINGS

In order to more clearly explain the embodiments of the present application or the technical solutions in the related art, the drawings used in the description of the embodiments or the related art will be briefly introduced below. Obviously, the drawings in the following description are merely some embodiments of the present application. For those of ordinary skill in the art, other drawings can be obtained based on the structure shown in these drawings without creative work.

Description of reference numerals in the figures.

Figure 1:
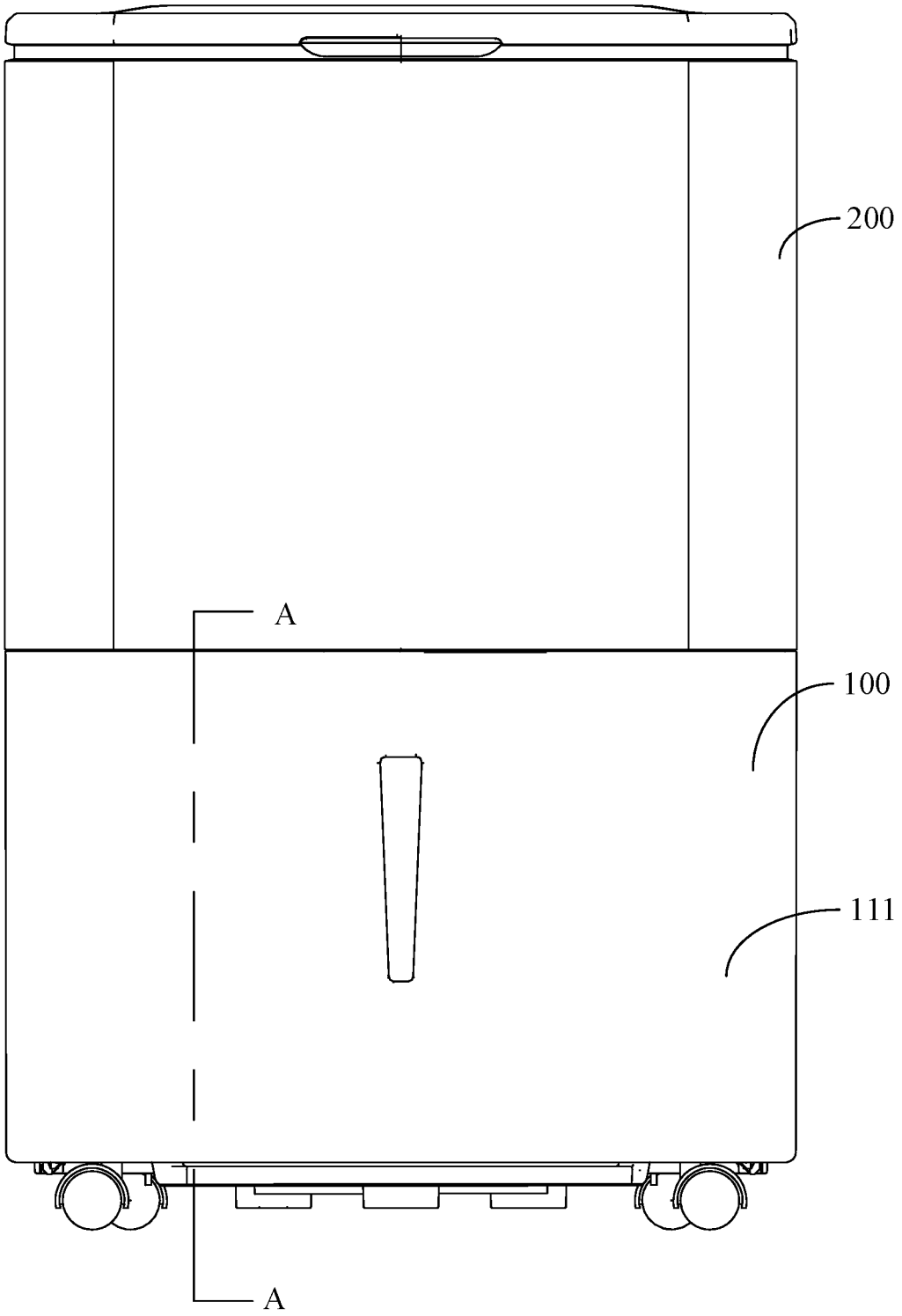
FIG. 1 is a schematic structural diagram of a dehumidifier of an embodiment of the present application.

| Reference numeral | Name | Reference numeral | Name |
|---|---|---|---|
| 100 | Water tank | 110 | Tank body |
| 111 | Front plate | 112 | Back plate |
| 113 | Abutment member | 200 | Housing |
| 210 | Mounting groove | 220 | Partition plate |
| 221 | Second adapter | 230 | Alignment hole |
| 240 | Accommodation cavity | 400 | Water tank water outlet pipe |
| 500 | Pumping bracket | 510 | Mounting pipe |
| 520 | Filter | 530 | First adapter |
| 531 | Limiting protrusion | 532 | Second bolt |
| 540 | Bracket body | 541 | Mounting protrusion |
| 542 | First bolt | 543 | Limiting hole |
| 600 | Micro switch | 610 | Elastic trigger plate |

The realization of the purposes, functional features and advantages of the present application will be further explained with reference to the accompanying drawings in combination with the embodiments.

DETAILED DESCRIPTION OF THE EMBODIMENTS

In the following, the technical solutions in the embodiments of the present application will be clearly and completely described with reference to the drawings in the embodiments of the present application. Obviously, the described embodiments are only some of the embodiments of the present application, and not all of the embodiments. Based on the embodiments of the present application, all other embodiments obtained by those of ordinary skilled in the art without creative efforts shall fall within the claimed scope of the present application.

It should be noted that all directional indicators (such as up, down, left, right, front, back, etc.) in the embodiments of the present application are only used to explain the relative positional relationship, movement situation, etc. between components in a specific attitude (as shown in the drawings). If the specific attitude changes, the directional indication also changes accordingly.

In addition, the descriptions related to "first," "second," and the like in the present application are for descriptive purposes only, and should not be understood as indicating or implying their relative importance or implicitly indicating the number of technical features indicated. Therefore, a feature associated with "first" and "second" may explicitly or implicitly include at least one of such feature. In addition, the technical solutions of the various embodiments can be combined with each other, but they must be based on what can be achieved by those of ordinary skill in the art. When the combination of technical solutions is contradictory or cannot be achieved, it should be considered that such a combination of technical solutions does not exist, and is not within the scope of protection defined by the claims of the present application.

The present application provides a dehumidifier.

In an embodiment of the present application, as shown in FIGS. 1 to 4, the dehumidifier includes:

- a housing 200 having a mounting groove 210;
- a water tank 100 detachably inserted in the mounting groove 210 and provided with an abutment member 113;
- a pump assembly including a water pump (not shown) and a water pump inlet pipe (not shown) having one end connected to the water pump;
- a water tank outlet pipe 400 having one end detachably connected to another end of the water pump inlet pipe, and another end of the water tank outlet pipe 400 being located in the water tank 100; and
- a micro switch 600 mounted at the housing 200;
- when the water tank 100 is installed in place, an abutment member 113 presses the micro switch 600 to connect the water pump and the power supply, and the water pump inlet pipe communicates with the water tank outlet pipe 400.

In this embodiment, the water tank 100 is movably inserted in a mounting groove 210 of the housing 200, which is convenient for cleaning the water tank 100 and checking and repairing components of the water tank 100. When the water tank 100 is moved out of the mounting groove 210, the water tank outlet pipe 400 is moved out of the mounting groove 210 along with the water tank 100. When the dehumidifier is to work, the water tank 100 is inserted into the mounting groove 210, the micro switch 600 is pressed by the abutment member 113 of a tank body 110, the water tank outlet pipe 400 is communicated with the water pump inlet pipe, and the micro switch 600 is closed, so that the water pump is electrically connected to the power supply, and then the water pump starts to work and pumps out the water in the water tank 100 through the water tank outlet pipe 400, thereby draining the water tank 100. Specifically in the present embodiment, when the water tank 100 is not installed in place, the abutment member 113 is misaligned with the micro switch 600 and the micro switch 600 is opened so that the water pump is disconnected from the power supply.

In the technical solution of the present application, the micro switch 600 at the housing 200 cooperates with the abutment member 113 of the water tank 100, to verify whether the water tank 100 is installed in place and whether the water tank outlet pipe 400 is communicated with the water pump. When the water tank 100 is installed in place, the water tank outlet pipe 400 is connected to the water pump inlet pipe, so as to communicate with the water pump. At this time, the abutment member 113 presses the micro switch 600, so that the water pump is electrically connected to the power supply, and the water pump works to pump water out of the water tank 100 without idling. When the abutment member 113 does not abut against the micro switch 600, the micro switch 600 is in an off state, so that the water pump is disconnected from the power supply, and the water pump cannot work, thereby ensuring that the water pump is not in an idle state.

Figure 3:
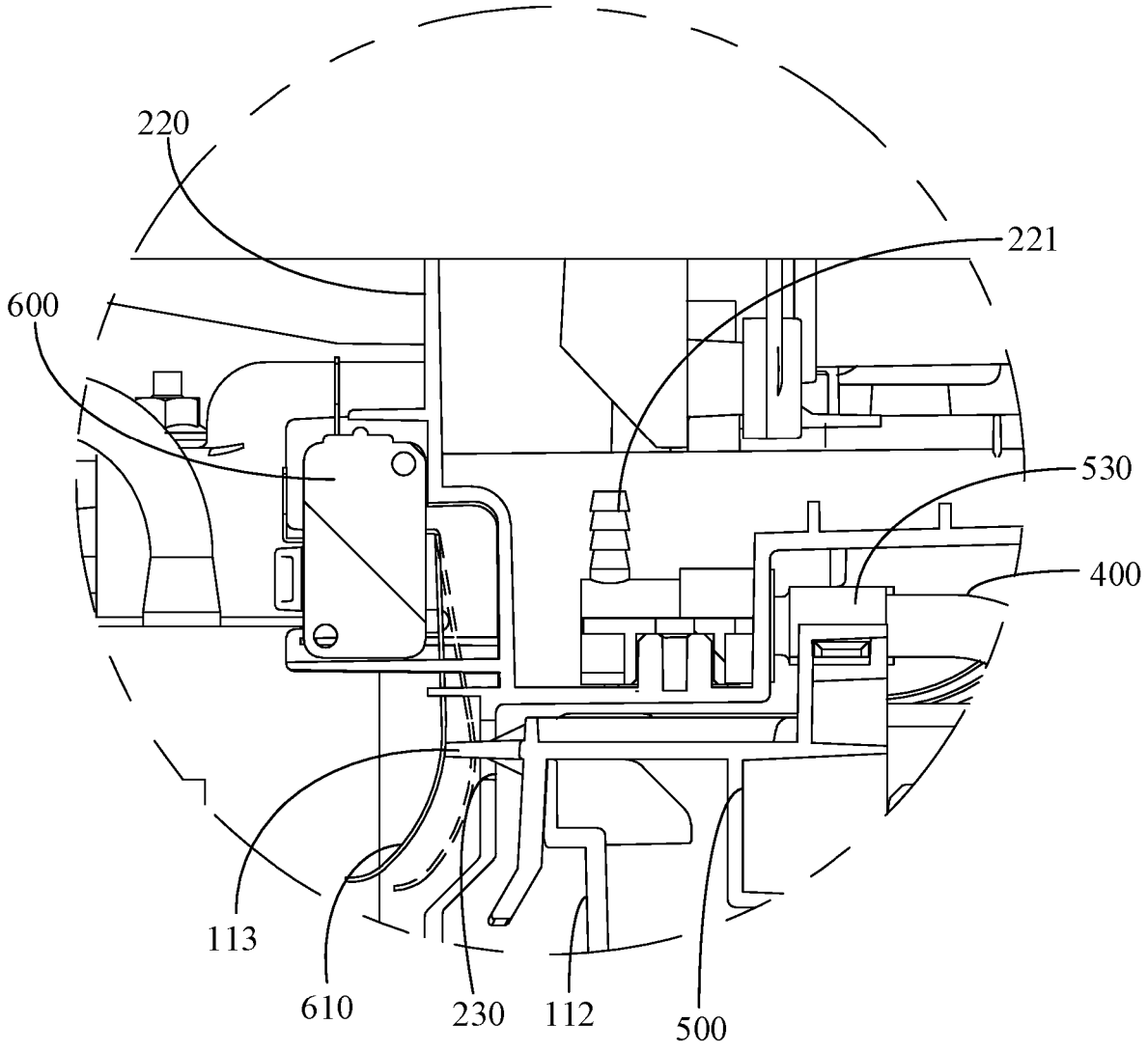
FIG. 3 is an enlarged view of portion B of FIG. 2.
Figure 4:
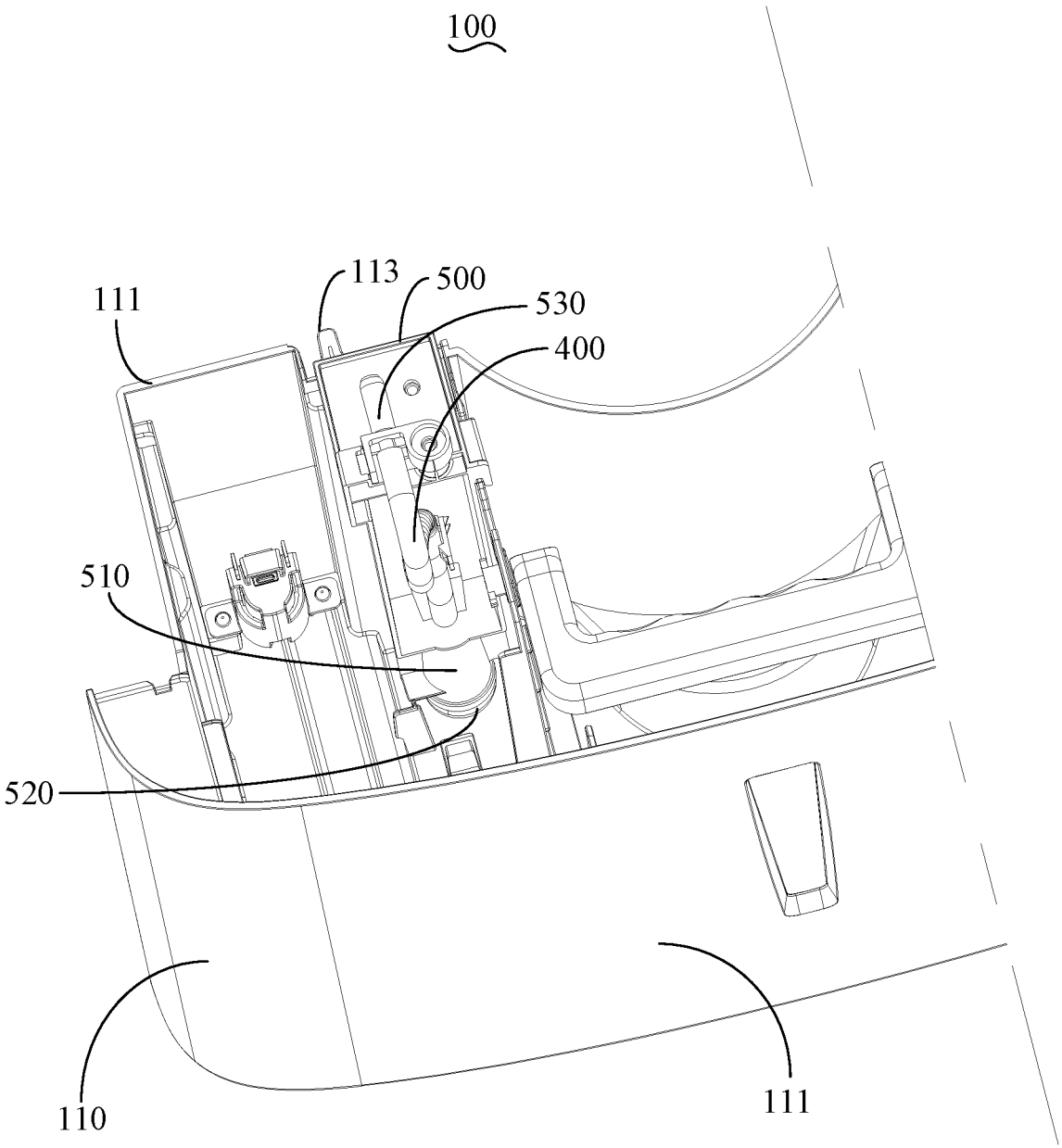
FIG. 4 is a partial structural diagram of a water tank of the dehumidifier of FIG. 1.

In this embodiment, as shown in FIGS. 3 and 4, the water tank 100 further includes a pumping bracket 500 connected to the water tank outlet pipe 400. The pumping bracket 500 has the function of fixing the water tank outlet pipe 400. The water tank outlet pipe 400 is prone to vibrate under the impact of water flow when the water pump pumps water, which causes the water tank outlet pipe 400 to be separated from the water pump inlet pipe. The pumping bracket 500 fixes the water tank outlet pipe 400, so that the water tank outlet pipe 400 and the water pump inlet pipe are stably connected, and the water tank outlet pipe 400 and the water pump inlet pipe can be effectively prevented from being separated when the water pump works.

Figure 2:
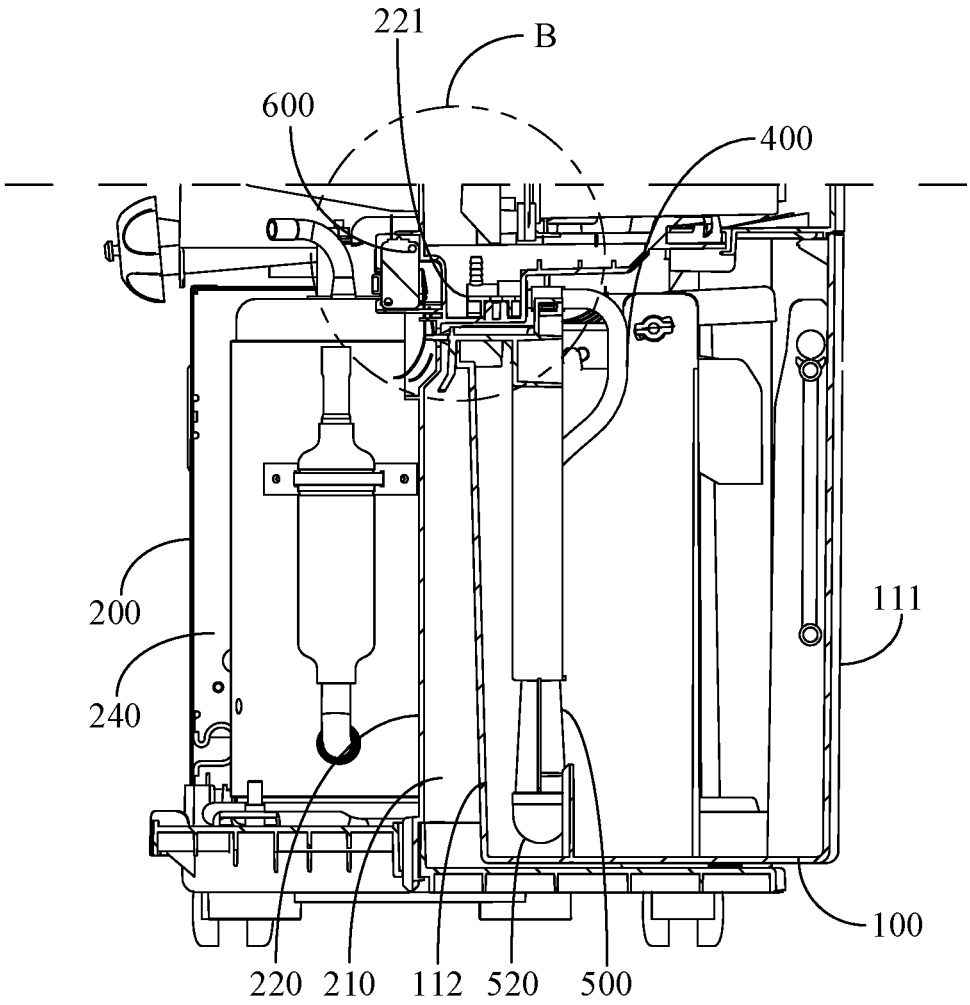
FIG. 2 is a sectional view along A-A of the dehumidifier of FIG. 1.

Further in this embodiment, as shown in FIGS. 2 and 3, the tank body 110 of the water tank 100 includes a front plate 111 and a back plate 112 disposed opposite to the front plate 111.

The pumping bracket 500 is connected to the back plate 112. After the water tank 100 is installed, the back plate 112 is located in the mounting groove 210. Since that the pumping bracket 500 is arranged on the back plate 112, the pumping bracket 500 is hidden after the water tank 100 is installed, which is beneficial to make the dehumidifier look neat and beautiful. The pumping bracket 500 is connected to both the water tank outlet pipe 400 and the back plate 112, so that the water tank outlet pipe 400 is farther away from an opening of the mounting groove 210 after the water tank 100 is installed, which is beneficial to prevent the water tank outlet pipe 400 from extending out of the mounting groove 210. The pumping bracket 500 in this embodiment is not limited to the above technical scheme. In other embodiments, the tank body of the water tank includes a front plate and a side plate connected to the front plate. The pumping bracket is connected to the side plate, the pumping bracket is hidden after the water tank is installed, which is beneficial to make the dehumidifier look neat and beautiful.

Further, in this embodiment, as shown in FIGS. 3 and 4, the abutment member 113 is an abutment protrusion provided at the pumping bracket 500. The abutment protrusion is located at an outer side of the water tank 100 and extends in a direction away from the front plate 111. The abutment protrusion is arranged on the pumping bracket 500 which is connected to the water tank outlet pipe 400, thereby the abutment protrusion is close to the water tank outlet pipe 400, and an installation state of the abutment protrusion is synchronized with an installation state of the water tank outlet pipe 400, which is beneficial to ensure that the water tank outlet pipe 400 is communicated with the water pump inlet pipe when the abutment protrusion abuts against the micro switch 600. The abutment protrusion is located at an outer side of the water tank 100 and extends in a direction away from the front plate 111, so that there is a larger space for the free end of the abutment protrusion and it facilitates the abutment protrusion to contact the micro switch 600.

The abutment protrusion described in the present application is not limited to the above technical scheme. In another embodiment, the abutment protrusion can be provided at an outer surface of the back plate, or, the abutment protrusion is provided at an outer surface of the side plate connected to the front plate. Further, the micro switch is provided at a wall of the mounting groove close to the side plate. When the water tank is installed in place, the abutment protrusion abuts against the micro switch.

Further, in this embodiment, as shown in FIGS. 2 and 3, the housing 200 also includes a partition plate 220 forming a bottom of the mounting groove 210. An accommodation cavity 240 is formed at a side of the partition plate 220 away from the mounting groove 210 in the housing 200, and an alignment hole 230 communicating the mounting groove 210 and the accommodation cavity 240 is formed at the partition plate 220. The micro switch 600 is located in the accommodation cavity 240 and faces the alignment hole 230. The abutment protrusion is movably disposed through the alignment hole 230 to abut against the micro switch 600. Specifically the mounting groove 210 has an opening and a bottom opposite to the opening. The partition plate 220 forms the bottom of the mounting groove 210. The micro switch 600 is provided in the accommodation cavity 240 to reduce the risk of being squeezed by the water tank 100 and being sputtered by water of the water tank 100, and make the micro switch 600 safer.

The partition plate 220 is provided with the alignment hole 230, so that when the water tank 100 is installed, the abutment protrusion needs to be accurately aligned with the alignment hole 230 before passing through the alignment hole 230 to abut against the micro switch 600. The alignment hole 230 is beneficial for improvement of the installation accuracy of the water tank 100, avoiding that the abutment protrusion mistakenly touches the micro switch 600, and improving the synchronization degree of events of the abutment protrusion pressing the micro switch 600 and the water tank outlet pipe 400 being connected to the water pump inlet pipe, thereby improving the safety of the water pump.

The embodiment is not limited to the above technical scheme, in another embodiment, the bottom of the mounting groove is provided with a mounting sink groove facing the abutment protrusion. The micro switch is disposed in the mounting sink groove to facilitate the assembly and disassembly of the micro switch. The water tank is inserted in the mounting groove and pushed inward. The water tank is installed in place when the abutment protrusion presses against the micro switch, and at the same time the water tank outlet pipe is connected to the water pump inlet pipe.

Further, in this embodiment, as shown in FIGS. 3 and 4, the pumping bracket 500 is provided with a first adapter 530, an outlet end of the water tank outlet pipe 400 is connected to the first adapter 530, the partition plate 220 is provided with a second adapter 221 communicating with the mounting groove 210, an inlet end of the water pump inlet pipe is connected to the second adapter 221, and the first adapter 530 is detachably plugged to the second adapter 221. The water tank outlet pipe 400 and the water pump inlet pipe in this embodiment are detachably plugged through the first adapter 530 and the second adapter 221. When the water tank 100 is installed in place, the first adapter 530 is plugged into the second adapter 221 so that the water tank outlet pipe 400 communicates with the water pump inlet pipe. When the water tank 100 is drawn out of the mounting tank 210, the first adapter 530 is pulled out of the second adapter 221 so that the water tank outlet pipe 400 is disconnected from the water pump inlet pipe. The first adapter 530 is disposed on the pumping bracket 500, so that the first adapter 530 is stable, the second adapter 221 is disposed on the partition plate 220, so that the second adapter 221 is stable with less shaking, these are beneficial to making the first adapter 530 and the second adapter 221 easier to align with each other when the water tank 100 is being installed, thus increasing the success rate of the butt connection.

The plug structures of the water tank outlet pipe 400 and the water pump inlet pipe of this embodiment are not limited to the above technical scheme. In another embodiment, the pumping bracket is provided with the second adapter, and the outlet end of the water tank outlet pipe is connected to the second adapter. The partition plate is provided with the first adapter communicating with the mounting groove, the inlet end of the water pump inlet pipe is connected to the first adapter, and the first adapter is detachably plugged to the second adapter.

The detachable connection structures of the water tank outlet pipe 400 and the water pump inlet pipe of this embodiment are not limited to the above technical scheme. In another embodiment, it can be that a magnetic main buckle is provided at the inlet end of the water pump inlet pipe, a magnetic auxiliary buckle is provided at the outlet end of the water tank outlet pipe, and the water pump inlet pipe is magnetically connected to the water tank outlet pipe, which has the advantage of making both the assembly and disassembly of the water tank outlet pipe 400 and the water pump inlet pipe easy.

Figure 5:
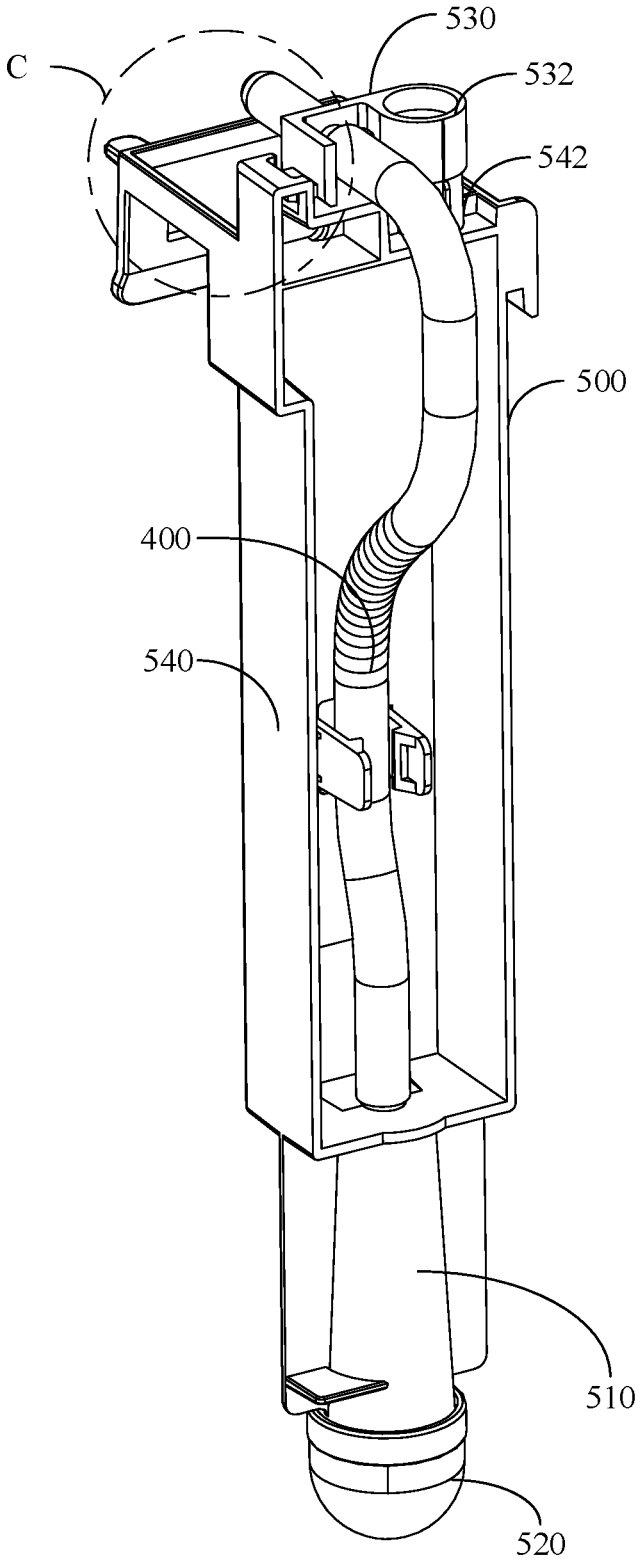
FIG. 5 is a schematic structural diagram of a water tank outlet pipe of a pumping bracket of the dehumidifier of FIG. 1.
Figure 6:
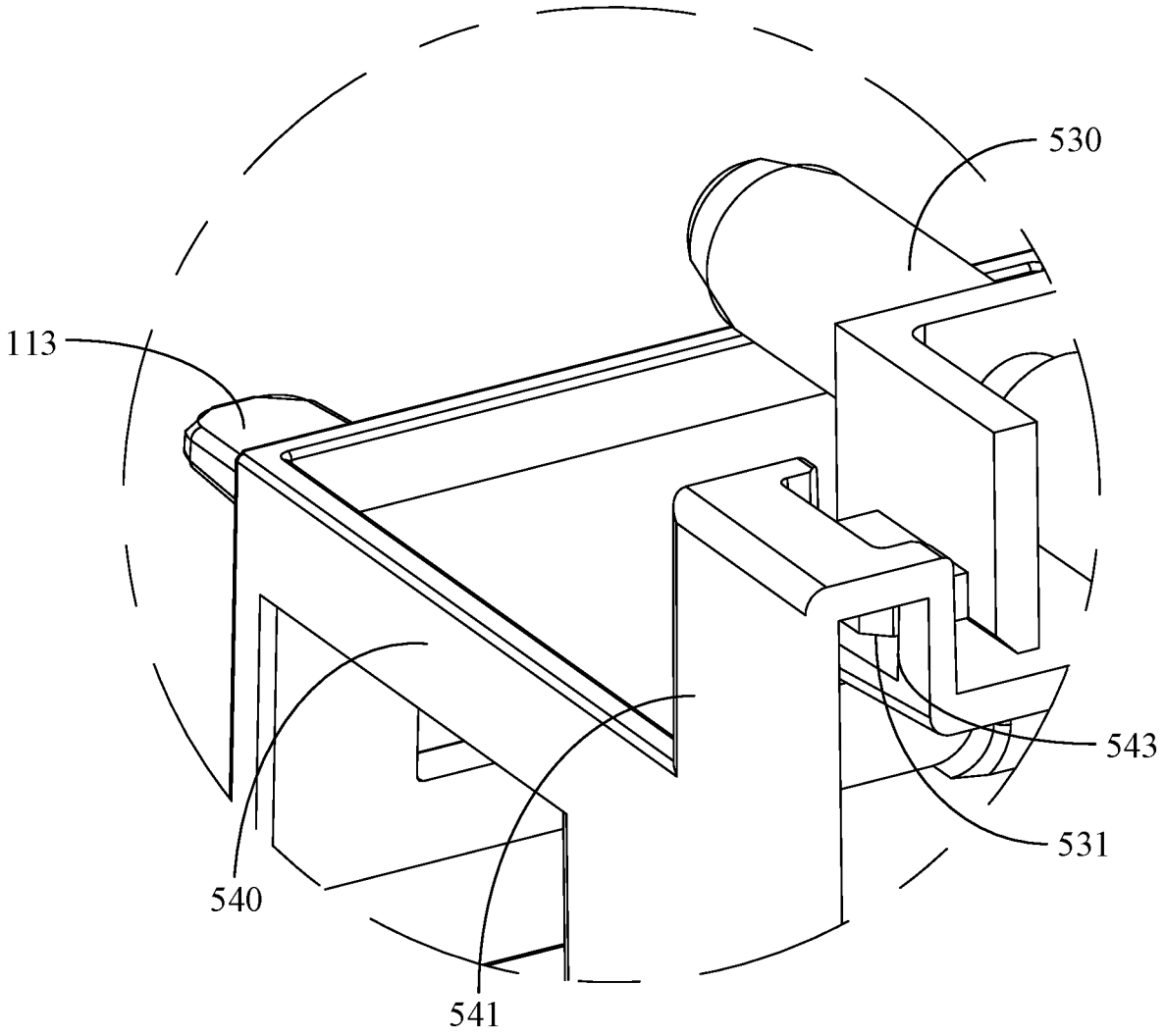
FIG. 6 is an enlarged view of portion C of FIG. 5.

Further, in this embodiment, as shown in FIGS. 5 and 6, the pumping bracket 500 includes a bracket body 540 and the first adapter 530. The bracket body includes the abutment protrusion and is connected to the back plate 112. A top of the bracket body 540 includes a mounting protrusion 541 and a first bolt 542 disposed at interval, the mounting protrusion 541 having a limiting hole 543 facing the first bolt 542, and the first adapter 530 includes a limiting protrusion 531 adapted to the limiting hole 543 and a second bolt 532 adapted to the first bolt 542. When the first adapter 530 is to be connected to the bracket body 540, first the limiting protrusion 531 is inserted into the limiting hole 543, so that the second bolt 532 is aligned with the first bolt 542, secondly the first bolt 542 and the second bolt 532 are connected by screws, so that the first adapter 530 is fixed, which has the advantages of making both the disassembly and assembly of the first adapter easy and the first adapter is stably installed. The pumping bracket 500 described in this embodiment is not limited to the above technical scheme, in another embodiment, the pumping bracket may include a bracket and a first adapter integrally formed to facilitate the assembly of the water tank.

Further, in this embodiment, as shown in FIG. 3, the micro switch 600 includes an elastic trigger plate 610, and the micro switch 600 has a first state in which the abutment member 113 presses against the elastic trigger plate 610 to close the micro switch 600, and a second state in which the elastic trigger plate 610 resets and the micro switch 600 is opened. In this embodiment, the micro switch 600 in the closed state can be opened without a second trigger, and simply making the abutment member 113 leave the micro switch 600 will realize the opening of the micro switch 600, so as to realize the resetting of the micro switch 600, which has the advantage of convenient operation. It should be noted that the elastic trigger plate 610 indicated by dotted lines in FIG. 3 is in a state after being reset.

Further, in this embodiment, as shown in FIG. 4, the pumping bracket 500 is detachably connected to the tank body 110 of the water tank 100 to facilitate overhaul of the water tank outlet pipe 400. When the water tank outlet pipe 400 needs to be overhauled, the pumping bracket 500 is first removed from the tank body 110 to facilitate workers to check and dredge the water tank outlet pipe 400. After the overhaul is finished, the pumping bracket 500 is installed at the back of the water tank 100. The pumping bracket 500 in this embodiment is not limited to the above technical scheme. In another embodiment, the pumping bracket and the tank body of the water tank can be integrally formed, which can reduce the number of parts to be assembled in the water tank, and is beneficial to improve the assembly efficiency of the water tank, and also makes the pumping bracket be connected stably.

Further, in this embodiment, as shown in FIG. 4, the pumping bracket 500 is buckled to the tank body 110 of the water tank 100, which achieves a high disassembly efficiency and a high assembly efficiency. The pumping bracket 500 and the tank body 110 of the water tank 100 in this embodiment are not limited to the above technical scheme. In another embodiment, the pumping bracket and the tank body of the water tank can be connected by screws, which makes the pumping bracket be connected stably.

Further, in this embodiment, as shown in FIG. 4, the pumping bracket 500 includes a mounting end extending into the water tank 100, the mounting end is provided with a filter 520 communicating with the inlet end of the water tank outlet pipe 400. The filter 520 can greatly reduce the probability that the water tank outlet pipe 400 is blocked, which is beneficial to prolong the service lives of the water tank outlet pipe 400 and the water pump. Specifically, the filter 520 in this embodiment may be a filter screen, a filter sponge, a combined filter 520 combined by a filter screen and a filter sponge, or the like. The filter 520 is installed at the pumping bracket 500, and has a stable position and a stable filtering effect, and it is convenient for the water tank outlet pipe 400 to be communicated with the filter 520. The filter 520 in this embodiment is not limited to the above technical schemes. In another embodiment, the filter may be provided at the inlet end of the water tank outlet pipe, which has the effect of prolonging the service lives of the water tank outlet pipe and the water pump.

Further, in this embodiment, as shown in FIG. 4, the water tank outlet pipe 400 is a hose. The mounting end of the pumping bracket 500 is provided with a mounting pipe 510, the filter 520 is provided at an inlet end of the mounting pipe 510, and the inlet end of the water tank outlet pipe 400 is connected to an outlet end of the mounting pipe 510. The water tank outlet pipe 400 typically needs to be bent during installation, in this embodiment, the water tank outlet pipe 400 being a hose has less requirement on the length accuracy. The installation of the hose is not affected when the length of the hose is longer than a distance between the first adapter 530 and the mounting pipe 510, and the installation is convenient. At the same time, the autogenous shrinkage performance of the hose is beneficial to improve the sealing performance of the assembly. In the present embodiment, when the pump pumps water, the water in the water tank 100 is filtered through the filter 520, passes through the mounting pipe 510, the water tank outlet pipe 400, and the first adapter 530 in turn, and is then conducted to the water pump inlet pipe, and finally pumped out by the water pump. The inlet end of the water tank outlet pipe 400 is connected to the mounting pipe 510. The mounting pipe 510 has a stable position and is not easy to shake, which is beneficial to the stable pumping of the water pump. The mounting pipe 510 can increase a length of the water tank outlet pipe 400, which is beneficial to stabilize the action position of the water pump to be close to the bottom of the water tank 100, thereby pumping more water out of the water tank 100.

Further in this embodiment, as shown in FIG. 4, an inlet of the mounting pipe 510 is trumpet-shaped, so that a radius of the outlet end of the mounting pipe 510 is smaller than a radius of the inlet end of the mounting pipe 510. The filter 520 reduces an inlet area of the mounting pipe 510. Therefore, the inlet of the mounting pipe 510 is trumpet-shaped to enlarge the inlet of the mounting pipe 510 to ensure a water inflow of the mounting pipe 510, thereby ensuring the drainage efficiency of the water tank 100.

Specifically, the water pump in this embodiment is located inside the housing 200 and connected to the housing 200, however the water pump is not limited to this technical scheme. In another embodiment, the water pump may be located outside the housing 200. The dehumidifier also includes a condenser and an evaporator disposed in the housing 200, and a compressor disposed in the accommodation cavity 240. Refrigerant circulates among the condenser, the evaporator and the compressor. When the dehumidifier works, a temperature of surfaces of the evaporator is low, and the moisture in the air condenses on the surfaces of the evaporator, and then flows to the water tank 100. When the water in the water tank 100 reaches a certain level, the water pump is turned on, and the water in the water tank 100 is discharged by the water pump.

The above are only preferred embodiments of the present application, and are not therefore limiting the scope of the present application. Any equivalent structural transformation made by using the contents of the specification and drawings of the present application or any direct/indirect application in other related technical fields under the inventive concept of the present application is included in the claimed scope of the present application.

What is claimed is:

1. A dehumidifier comprising:

a housing having a mounting groove;

a water tank detachably inserted in the mounting groove and including an abutment member and a bracket;

a pump assembly including a water pump and a water pump inlet pipe, a first end of the water pump inlet pipe being connected to the water pump;

a water tank outlet pipe, a first end of the water tank outlet pipe being detachably connected to a second end of the water pump inlet pipe, and a second end of the water tank outlet pipe being located in the water tank; and a micro switch installed at the housing;

wherein when the water tank is installed in place, the micro switch is pressed by the abutment member to connect the water pump to a power supply, and the water pump inlet pipe is communicated with the water tank outlet pipe; and wherein the bracket is connected to the water tank outlet pipe.

2. The dehumidifier of claim 1, wherein:

a tank body of the water tank includes a front plate and a back plate opposite to the front plate; and the bracket is connected to the back plate.

3. The dehumidifier of claim 2, wherein the abutment member includes an abutment protrusion formed at the bracket, located at an outer side of the water tank, and extending away from the front plate.

4. The dehumidifier of claim 3, wherein:

the housing further includes a partition plate forming a bottom of the mounting groove, an accommodation cavity being formed at a side of the partition plate away from the mounting groove;

the partition plate is provided with an alignment hole communicating with the mounting groove and the accommodation cavity;

the micro switch is located in the accommodation cavity and faces the alignment hole; and the abutment protrusion is movably disposed through the alignment hole to abut against the micro switch.

5. The dehumidifier of claim 4, wherein:

the bracket includes a first adapter connected to the first end of the water tank outlet pipe;

the partition plate includes a second adapter communicating with the mounting groove and connected to the second end of the water pump inlet pipe; and the first adapter is detachably plugged to the second adapter.

6. The dehumidifier of claim 5, wherein:

the bracket further includes a bracket body including the abutment protrusion and connected to the back plate;

a top of the bracket body includes a mounting protrusion and a first bolt arranged at an interval, the mounting protrusion having a limiting hole facing the first bolt; and the first adapter includes:

a limiting protrusion adapted to the alignment hole; and a second bolt adapted to the first bolt.

7. The dehumidifier of claim 1, wherein the bracket is detachably connected to a tank body of the water tank.

8. The dehumidifier of claim 7, wherein the bracket is buckled to the tank body of the water tank.

9. The dehumidifier of claim 7, wherein the bracket includes a mounting end extending into the water tank and including a filter, the second end of the water tank outlet pipe being communicated with the filter.

10. The dehumidifier of claim 9, wherein:

the water tank outlet pipe includes a hose;

the mounting end of the bracket includes a mounting pipe;

the filter is provided at an inlet end of the mounting pipe; and the second end of the water tank outlet pipe is connected to an outlet end of the mounting pipe.

11. The dehumidifier of claim 10, wherein:

an inlet of the mounting pipe is trumpet-shaped, and a radius of the outlet end of the mounting pipe is smaller than a radius of the inlet end of the mounting pipe.

12. The dehumidifier of claim 1, wherein:

the micro switch includes an elastic trigger plate; and the micro switch has:

a first state in which the abutment member abuts against the elastic trigger plate to open the micro switch, and a second state in which the elastic trigger plate is reset and the micro switch is closed.

13. The dehumidifier of claim 1, wherein the water pump is located inside the housing and connected to the housing.

* * * * *